United States Patent [19]

Akino

[11] 4,378,077

[45] Mar. 29, 1983

[54] FEEDER CAP

[75] Inventor: Kinji Akino, Shizuoka, Japan

[73] Assignees: Shinwa Ind. Co., Ltd., Shizuoka; Ricoh Co. Ltd., Tokyo, both of Japan

[21] Appl. No.: 226,169

[22] Filed: Jan. 19, 1981

[30] Foreign Application Priority Data

Jan. 22, 1980 [JP] Japan ..... 55-006116[U]

[51] Int. Cl.[3] ..... B65D 47/12

[52] U.S. Cl. ..... 222/182; 222/501; 222/518; 222/545

[58] Field of Search ..... 222/182, 153, 402.11, 222/402.14, 501, 518, 545, 498; 137/233, 234; 401/262, 264

[56] References Cited

U.S. PATENT DOCUMENTS

| | | | |
|---|---|---|---|
| 3,739,941 | 6/1973 | Ostrwosky et al. | 222/153 |
| 3,844,448 | 10/1974 | Sette | 222/153 |
| 4,164,307 | 8/1979 | Imamuta et al. | 222/182 |

FOREIGN PATENT DOCUMENTS

| | | |
|---|---|---|
| 52-147656 | 11/1977 | Japan . |
| 53-45158 | 4/1978 | Japan . |

*Primary Examiner*—H. Grant Skaggs

[57] ABSTRACT

A feeder cap used for liquid containers of duplicating machines, etc. The feeder cap comprises a cap body provided on its inner surface with a threaded portion fitting the threaded mouth of a container, a hollow cylinder through which liquid is supplied from the container, the hollow cylinder being disposed in the center of, and passing through, the cap body, a nonrotatable valve stem or rod disposed in the center of the hollow cylinder so as to pass through the hollow cylinder, a spring surrounding the valve rod, an engagement piece fixed to the upper end of the valve rod, the engagement piece being provided on opposing sides thereof with projecting portions or ears, each having an inclined lower edge, a valve which fits the lower end (valve seat) of the hollow cylinder and is attached to the lower end of the valve rod, an auxiliary cap detachably fitted to the upper portion of the hollow cylinder, a supporting plate (disc) disposed inside the auxiliary cap at right angles to the valve rod, the supporting plate being provided in its center with an opening, circular in the center with a slot to each side, into which the engagement piece is inserted, each side of the opening having an arc-shaped inclined portion whose upper and lower surfaces are both inclined. The inclined portions are adapted so that the inclined lower edges of the engagement piece move onto the upper surfaces of the inclined portions from their lower portions when the auxiliary cap is turned in a certain direction (Clockwise) and that the projecting portions of the engagement piece move under the lower surfaces of the inclined portions from their higher portions when the auxiliary cap is turned in the opposite direction. Thus, when the auxiliary cap is turned in the clockwise direction, the valve rod is pulled up and the valve is strongly pressed against the lower end of the hollow cylinder so as to prevent the leakage of liquid in the container during storage or transportation. When the auxiliary cap is turned in the opposite direction so as to remove it from the cap body, the valve rod is pushed down and the valve is separated from the lower end of the hollow cylinder so as to eliminate the sticking of the valve thereto. When the auxiliary cap has been removed from the upper portion of the hollow cylinder, the valve remains in contact with the lower end of the hollow cylinder.

2 Claims, 13 Drawing Figures

FEEDER CAP

BACKGROUND OF THE INVENTION

1. Field of the Invention

This invention relates to a feeder cap used for liquid containers of duplicating machines, etc.

2. Description of the Prior Art

Each liquid container of duplicating machines is usually provided with a feeder cap. When the liquid container is set upside down in a duplicating machine it supplies liquid through the feeder cap as a valve rod is axially moved by the action of a float. Because the valve rod is designed to be moved very easily in the axial direction in response to the action of the float, if the valve rod touches anything before the liquid container is set in the duplicating machine, the valve is liable to open and allow liquid to leak out of the container. Therefore, when the liquid container is not set in the duplicating machine, for instance when it is stored or transported, a regular cap is fitted to its mouth in place of the conventional feeder cap in order to close the mouth better. However, when the liquid container is shaken before use to stir liquid contained therein, the liquid may scatter out of the container and spot the users' clothes, etc. Also, when the regular cap is replaced by the feeder cap to set the container in the duplicating machine, the user's hands, clothes, etc. may be soiled by the liquid.

In an effort to overcome these disadvantages, the inventor has already provided an improved feeder cap as disclosed by Japanese Utility Model Laid-Open Publication No. Sho 53-45158 (Japanese Utility Model Application No. Sho 51-127066). The feeder cap of this Utility Model contains a valve mechanism comprising a valve and a valve seat, which mechanism does not operate when the container full of liquid is not set in the duplicating machine, so as to prevent the leakage of the liquid during the storage or transportation of the container. That is, as shown in FIG. 11, the feeder cap comprises a cap body 1', a hollow cylinder 8', through which liquid is supplied, disposed inside the cap body 1' so as to pass through it, a valve rod 9' disposed inside the hollow cylinder 8' so as to pass through it, an engagement piece 12' fixed to the upper end of the valve rod 9', said engagement piece 12' having inclined edges 15' under both ends thereof, a valve 13' fixed to the lower end of the valve rod 9', an auxiliary cap 2' detachably fitted to the upper portion of the hollow cylinder 8', a supporting plate 18' provided inside the auxiliary cap 2', an opening 19' corresponding to the engagement piece 12' being provided in the center of the supporting plate 18', and slopes 20' being formed only on the upper surfaces of both sides of the opening 19'. When the auxiliary cap 2' is turned prior to the storage or transportation of the container, the inclined edges 15' of the engagement piece 12' move onto the slopes 20' on both sides of the opening 19' to pull up the valve rod 9'. Then, the valve 13' is strongly pressed against the lower end (valve seat) of the hollow cylinder 8', and thus the leakage of liquid in the container 3 is completely prevented.

However, the aforesaid feeder cap has been found to have the following disadvantages; The feeder cap is designed only to pull up the valve rod 9' to press the valve 13' strongly against the lower end of the hollow cylinder 8' as mentioned above when the auxiliary cap 2' is turned, but the feeder cap does not have any means for pushing down the valve rod 9' to separate the valve 13' from the lower end of the hollow cylinder 8'. If the valve 13' remains strongly pressed against the lower end of the hollow cylinder 8' for a long period of time during the storage of the container, the valve 13' is liable to stick thereto due to the deposit of crystals from the liquid, so that it may not be moved easily. Then, even if the container 3 is set in the duplicating machine, the feeder cap in such a state will not be able to function at all. Therefore, it is necessary to eliminate the sticking of the valve 13' by separating it once from the lower end of the hollow cylinder 8' before the container 3 is set in the duplicating machine. However, because the feeder cap does not have any means for pushing down the valve rod 9' to separate the valve 13' from the lower end of the hollow cylinder 8', the user has to separate the valve 13' from the lower end of the hollow cylinder 8' by pushing down the valve rod 9' by hand after removing the auxiliary cap 2'. This is not only troublesome but also involves a possibility of liquid scattering out of the container and soiling the user's hands, clothes, etc.

Another improved feeder cap has already been disclosed by Japanese Utility Model Laid-Open Publication No. Sho 52-147656 (Japanese Utility Model Application No. Sho 51-54953). This is intended to be used for the same purpose as the above-mentioned feeder cap, but is different therefrom in the following points; The auxiliary cap is threadedly engaged with the cap body, the auxiliary cap is provided at its inside center with an internally threaded screw socket, and the valve rod is provided at its upper end with a disc fitting the internal thread of the screw socket, the pitch of the screw thread of said screw socket being slightly larger than the pitch of the interengaging screw threads of the auxiliary cap and the cap body. In this feeder cap, when the auxiliary cap is screwed, the disc fixed at the upper end of the valve rod is screwed into the screw socket and the valve rod is pulled up. Therefore, the valve fixed at the lower end of the valve rod is pressed against the valve seat so that the leakage of liquid in the container is completely prevented during storage or transportation.

However, this feeder cap has the following disadvantages: In the first place, it is rather complicated in construction, and is not necessarily easy to manufacture particularly because the disc at the upper end of the valve rod has to be precisely inclined so as to perfectly fit the internal thread of the screw socket. In the second place, when the auxiliary cap is screwed onto the cap body which has been fitted to the mouth of the container, it is very difficult to screw the disc fixed at the upper end of the valve rod into the screw socket inside the auxiliary cap because the valve rod is designed to move very sensitively in the axial direction.

BRIEF SUMMARY OF INVENTION

It is therefore a general object of this invention to provide a feeder cap which has obviated all the above-mentioned disadvantages of the prior art.

It is another object of this invention to provide a feeder cap which is designed not only to pull up a valve rod to press a valve strongly against the lower end of a hollow cylinder when an auxiliary cap is turned in a certain direction, but also to push down the valve rod to separate the valve from the lower end of the hollow cylinder when the auxiliary cap is turned in the opposite direction.

It is a further object of this invention to provide a feeder cap which is simple in construction, easy to manufacture, and easy to use.

These and other objects have been attained by further improving the feeder cap shown in FIG. 11, that is, by providing an incline on each side of an opening in a supporting plate in the auxiliary cap which is inclined not only on its upper surface but also on its lower surface, so that the inclined lower edges of an engagement piece move onto the upper surfaces of the inclined portions and the valve rod is pulled up thereby when the auxiliary cap is turned in a certain direction, and so that the projecting portions of the engagement piece move under the lower surfaces of the inclined portions and the valve rod is pushed down thereby when the auxiliary cap is turned in the opposite direction.

These and other objects and advantages of the invention will appear more fully from the following description.

DETAILED DESCRIPTION

Figure 1:
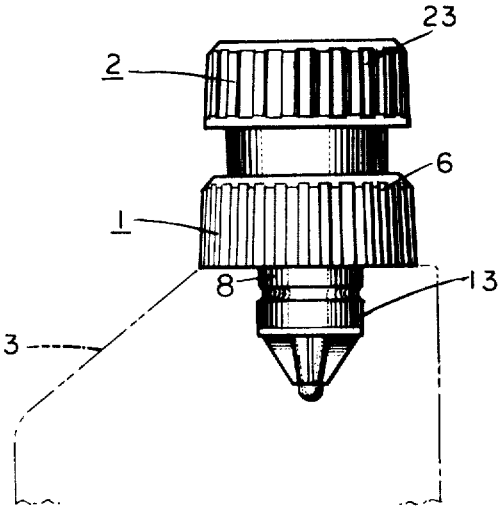
FIG. 1 is a front view of a feeder cap embodying the invention.

The present invention will now be described in detail, with reference to the attached drawings.

Numeral 1 represents a cap body, 2 an auxiliary cap, and 3 a container. The cap body 1 is provided on its inner surface with a threaded portion 5 fitting the threaded mouth 4 of the container 3, and is provided on its outer surface with knurls 6. The cap body 1 further has a sealing material 7 fixed to its portion to be in contact with the top of the mouth 4 of the container 3. In the center of the cap body 1, a hollow cylinder 8, through which liquid is supplied, is disposed so as to pass through it vertically. The hollow cylinder 8 has an outside diameter which permits insertion into the mouth 4 of the container 3, and is open at its upper and lower ends. This passage member, identified by numeral 8, has the general shape of a cylinder. It can have straight walls in the sense of a true cylinder with the same diameter throughout or can be tapered with a smaller diameter at the bottom, as shown in the various figures, this latter shape being my preferred embodiment.

Figure 2:
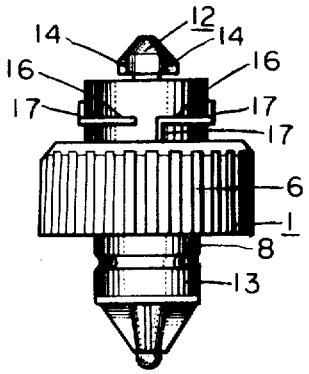
FIG. 2 is a front view of a cap body.
Figure 6A:
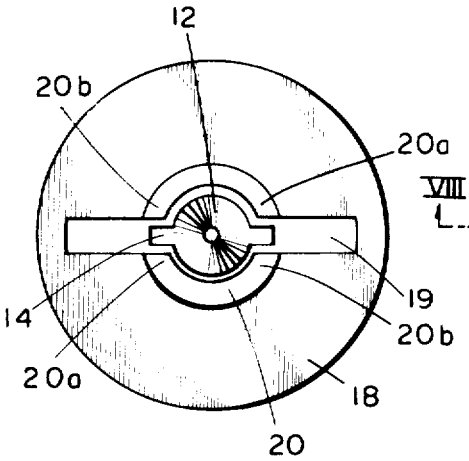
FIGS. 6(A), 6(B), 6(C) are enlarged plan views illustrating the relationship between inclined portions of a supporting plate and an engagement piece.
Figure 6B:
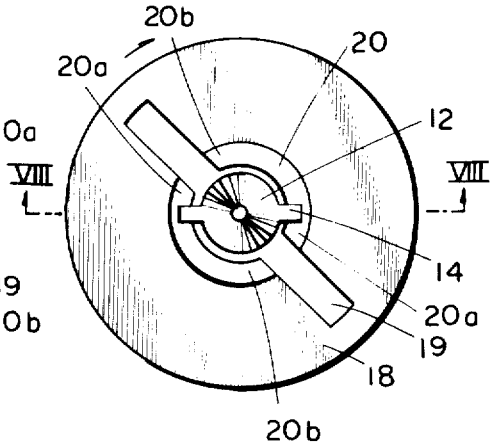
Figure 6C:
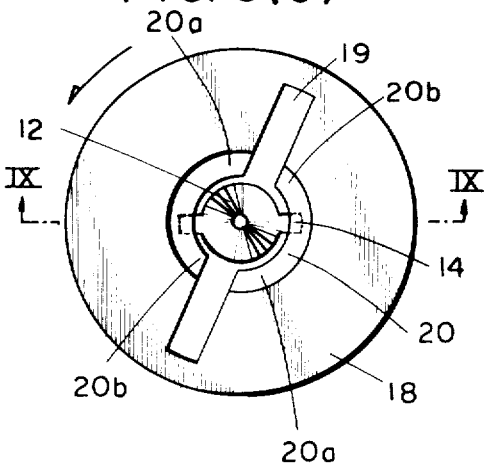
Figure 7:
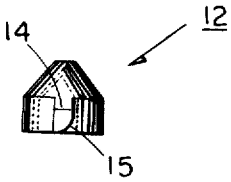
FIG. 7 is an enlarged side view of the engagement piece.

In the center of the hollow cylinder 8, a vertically movable valve rod or stem 9 is disposed. The valve rod 9 has a square cross section, for instance, and is supported in a valve rod guide 10 of similar cross section provided in the lower portion of the hollow cylinder 8 as shown in FIG. 4 so that the valve rod 9 does not turn even when the auxiliary cap 2 is turned. The valve rod 9 is surrounded by a spring 11 so that it is always pushed up by the force of the spring. An engagement piece 12 is fixed to the upper end of the valve rod 9, and a valve 13 is fixed to the lower end thereof. The engagement piece 12 comprises an upper portion of a substantially conical shape and projecting portions or ears 14 on both sides, each of which projecting portions has an inclined (rounded or beveled) lower edge. See FIGS. 3, 6 and 7. The valve 13 must be able to close completely the lower open end of the hollow cylinder 8 by closely contacting it. The hollow cylinder 8 projects upward from the upper surface of the cap body 1, and the projecting portion of the hollow cylinder 8 is provided on its outer surface with a pair of ridges 16 and with stoppers 17 as shown in FIG. 2. The ridges 16 are not spiral but parallel with supporting plate 18 provided inside the auxiliary cap 2, because the ridges 16 are to engage with projections provided on the inner surface of the auxiliary cap 2 not only for preventing the auxiliary cap 2 from coming off cap body 1 but also for preventing the auxiliary cap 2 from moving up when the auxiliary cap 2 is turned to push down the engagement piece 12. The ridges 16 are disposed on a greater part, not all, of the circumference of the hollow cylinder 8 because it must be possible to remove the auxiliary cap 2. The stoppers 17 prevent the auxiliary cap 2 from turning more than necessary.

Figure 3:
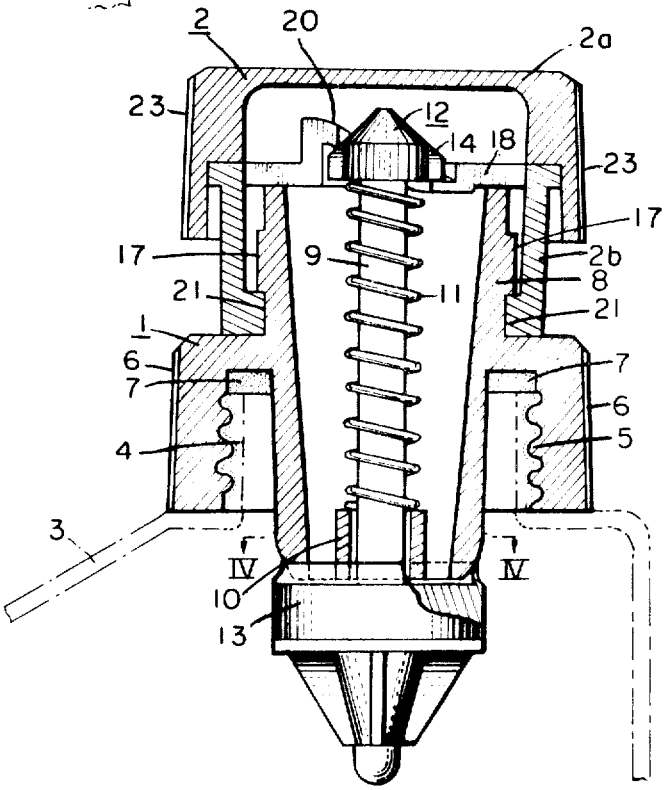
FIG. 3 is an enlarged vertical sectional front view of the feeder cap.
Figure 4:
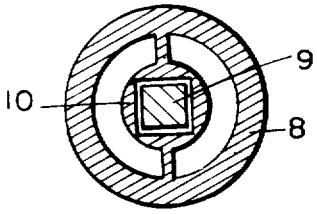
FIG. 4 is a sectional view taken on line IV—IV of FIG. 3.
Figure 8:
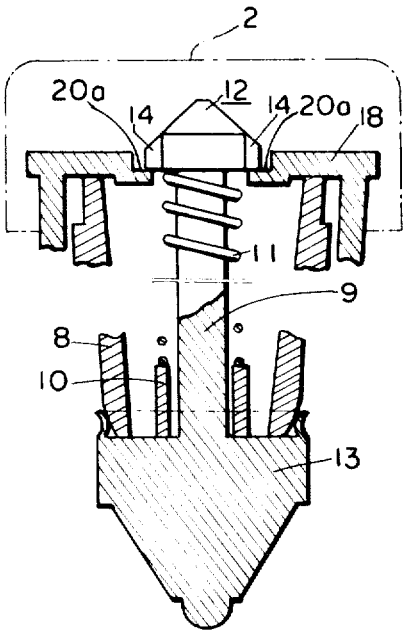
FIG. 8 is an end view taken on line VIII—VIII of FIG. 6(B).
Figure 9:
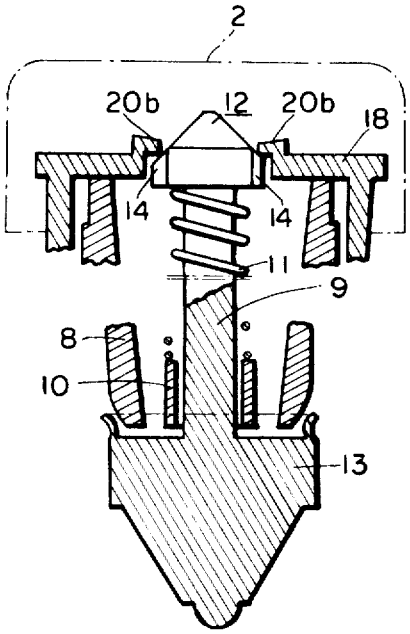
FIG. 9 is an end view taken on line IX—IX of FIG. 6(C).
Figure 10:
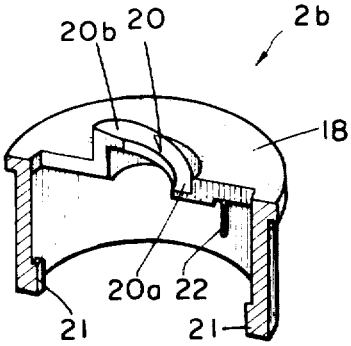
FIG. 10 is a partially cutaway view in perspective of the lower portion of an auxiliary cap.
Figure 11:
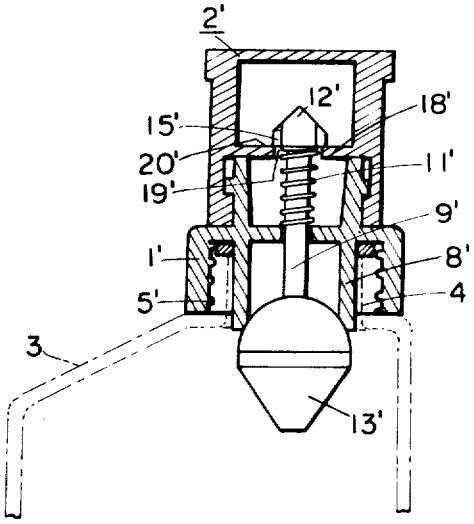
FIG. 11 is a vertical sectional front view of a feeder cap of the prior art.

The auxiliary cap 2 is detachably fitted to the upper portion of the hollow cylinder 8, that is, the portion projecting upward from the cap body 1, as shown in FIG. 3. Inside the auxiliary cap 2, the supporting plate 18 is disposed at right angles to the valve rod 9. The supporting plate 18 is provided in its center with an opening 19, circular in its center with a slot to each side, into which the engagement piece 12 is inserted. The supporting plate 18 is provided on each side of opening 19 with an arc-shaped inclined portion 20, the upper surface and the lower surface of each portion 20 both being inclined as shown in FIGS. 5, 6(A), 6(B), 6(C) and 10. The relationship between the inclined portions 20 and the engagement piece 12 is as follows: When the supporting plate 18 turns in a certain direction (as when the auxiliary cap 2 is turned clockwise), the inclined edges 15 of the engagement piece 12 move up onto the upper surfaces of the inclined portions 20 from their lower portions 20*a* as shown in FIGS. 6(B) and 8; and when the supporting plate 18 turns in the opposite direction (when the auxiliary cap 2 is turned in the opposite direction), the projecting portions 14 of the engagement piece 12 move under the lower surfaces of the inclined portions 20 from their higher portions 20*b* as shown in FIGS. 6(C) and 9. In either case, the engagement piece 12 does not turn even when the supporting plate 18 turns, because the engagement piece 12 is fixed to the nonrotatable valve rod 9.

Figure 5:
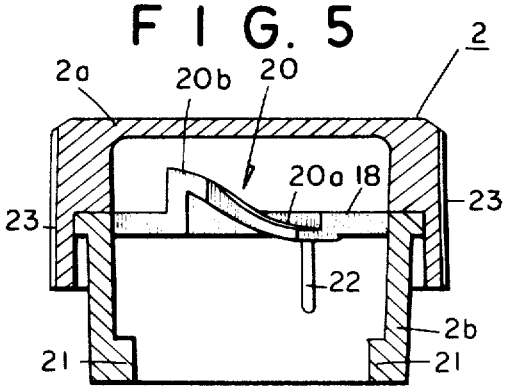
FIG. 5 is an enlarged vertical sectional front view of an auxiliary cap.

The auxiliary cap 2 is provided on its inner surface with projections 21 and 22 which cooperate with the ridges 16 and stoppers 17 provided on the outer surface of the hollow cylinder 8 as shown in FIG. 5. The auxiliary cap 2 is further provided on its outer surface with knurls 23. To facilitate manufacture, the auxiliary cap 2 in an embodiment illustrated in the drawings is divided into a cap-shaped upper portion 2a and a cylindrical lower portion 2b, and the supporting plate 18 is fixed to the lower portion 2b which is fitted in the upper portion 2a.

The operation of the feeder cap of this invention will now be described. To use the feeder cap, first the cap body 1 is fitted to the mouth 4 of the container 3 containing liquid. In this state, the valve 13 is in contact with the lower end of the hollow cylinder 8 because the valve rod 9 is pushed up by the spring 11. Secondly, the auxiliary cap 2 is fitted to the upper portion of the hollow cylinder 8 (FIG. 6(A)), and is turned in the direction of the arrow shown in FIG. 6(B). When the auxiliary cap 2 is turned in this direction, the inclined edges 15 of the engagement piece 12 move up onto the upper surfaces of the inclined portions 20 of the supporting plate 18 from their lower portions 20a. Therefore, the valve rod 9 is pulled up, and the valve 13 is pulled tightly against the lower end of the hollow cylinder 8. See FIGS. 8 and 6(B). Thus, the leakage of liquid is completely prevented. The container 3 is carried or stored in this state. Thirdly, prior to setting the container 3 in the duplicating machine, the container 3 is shaken to mix the liquid contents and then the auxiliary cap 2 is turned in the direction of the arrow shown in FIG. 6(C) and is removed from the upper portion of the hollow cylinder 8. When the auxiliary cap 2 is turned in this direction, the projecting portions 14 of the engagement piece 12 move under the lower surfaces of the inclined portions 20 of the supporting plate 18 from their higher portions 20b as shown in FIG. 6(C). Meanwhile, the auxiliary cap 2 (and therefore the supporting plate 18) does not move up even when the projecting portions 14 of the engagement piece 12 move under the lower surfaces of the inclined portions 20 of the supporting plate 18, because the projections 21 on the inner surface of the auxiliary cap 2 are in engagement with the ridges 16 provided on the outer surface of the hollow cylinder 8. Therefore, the engagement piece 12 is strongly pushed down against the force of the spring 11. Consequently the valve rod 9 is pushed down, and the valve 13 is separated from the lower end of the hollow cylinder 8. See FIGS. 9 and 6(C). When the auxiliary cap 2 is removed from the hollow cylinder 8 of the cap body 1 by further turning it in the same direction, the valve 13 is brought into contact with the lower end of the hollow cylinder 8 again by the force of the spring 11. Now the container 3 is set in the duplicating machine.

Thus, according to the present invention, it is possible not only to press the valve strongly against the lower end of the hollow cylinder to prevent completely the leakage of liquid in the container, by fitting the auxiliary cap to the hollow cylinder of the cap body and turning the auxiliary cap in a certain direction, but also to separate the valve surely from the lower end of the hollow cylinder by turning the auxiliary cap in the opposite direction. Therefore, even when the valve is stuck to the lower end of the hollow cylinder, the sticking of the valve can be eliminated automatically, and without soiling hands, clothes, etc. with liquid, simply by turning the auxiliary cap in said opposite direction. The auxiliary cap is then removed and the container is ready to be set in the duplicating machine. Also, the feeder cap of the present invention is simple in construction, easy to manufacture, and easy to use.

The feeder cap of the present invention can be used not only for liquid containers of duplicating machines but also for automatic feeders of liquids, oils, etc. to machines or for portable fuel feeders.

The term "hollow cylinder" as used in the specification and claims refers to hollow tubular members in general of circular cross section and is not limited to true cylindrical shapes.

As many apparently widely different embodiments of this invention may be made without departing from the spirit and scope thereof, it is to be understood that the invention is not limited to the specific embodiment thereof except as defined in the appended claims.

What is claimed is:

1. A feeder cap comprising a cap body provided on its inner surface with a threaded portion fitting the threaded mouth of a container, a hollow cylinder, through which liquid is supplied, disposed in the center of and passing through said cap body, a nonrotatable valve rod disposed in the center of said hollow cylinder so as to pass through said hollow cylinder, a valve rod guide in the lower portion of the hollow cylinder, an engagement piece fixed to the upper end of said valve rod, a spring surrounding said valve rod and being held in compression between said valve rod guide and said engagement piece so as to push up said valve rod, said engagement piece being provided on opposite sides thereof with a projecting portion, one of the lower edges of each projecting portion being inclined, said inclined lower edge being the corresponding one on each projecting portion, a valve fitting the lower end of said hollow cylinder being fixed to the lower end of said valve rod, an auxiliary cap detachably fitted to the upper portion of said hollow cylinder, a supporting plate disposed inside said auxiliary cap at right angles to said valve rod, said supporting plate being provided in its center with an opening into which said engagement piece is inserted and being provided on opposite sides of said opening with an arc-shaped inclined portion, both the upper surface and the lower surface of each said arc-shaped portions providing an incline so that the inclined lower edge of each of said projecting portions of said engagement piece moves up onto the upper surface of one of said arc-shaped portions from lower portions thereof so as to pull up said valve rod and thereby tightly press said valve against the lower end of said hollow cylinder when said auxiliary cap is turned in a certain direction, and so that each of the projecting portions of said engagement piece moves under the lower surface of one of said arc-shaped portions from higher portions thereof so as to push down said valve rod and thereby separate said valve from the lower end of said hollow cylinder when said auxiliary cap is turned in the opposite direction.

2. A feeder cap as claimed in claim 1, wherein said hollow cylinder is provided on the outer surface of its upper portion with a pair of ridges parallel to said supporting plate and with stoppers, and wherein said auxiliary cap is provided on its inner surface with projections which cooperate with said ridges and stoppers.

* * * * *